United States Patent [19]

Matsuoka et al.

[11] Patent Number: 5,055,876

[45] Date of Patent: Oct. 8, 1991

[54] IMAGE FORMATION APPARATUS HAVING A PROCESS CARTRIDGE ACTING AS GUIDANCE FOR A MEDIUM

[75] Inventors: Makoto Matsuoka, Kawasaki; Shigeki Sakakura, Tama, both of Japan

[73] Assignee: Fujitsu Limited, Kawasaki, Japan

[21] Appl. No.: 360,792

[22] Filed: Jun. 2, 1989

[30] Foreign Application Priority Data

Jun. 3, 1988 [JP] Japan ..... 63-135445

[51] Int. Cl.[5] ..... G03G 15/00

[52] U.S. Cl. ..... 355/211; 355/309

[58] Field of Search ..... 355/200, 210, 211, 309; 346/153.1, 160, 160.1

[56] References Cited

U.S. PATENT DOCUMENTS 4,538,896 9/1985 Tajima et al. ..... 355/200

FOREIGN PATENT DOCUMENTS

11122/70 8/1971 Australia .
B-53899/79 8/1980 Australia .
0232064 8/1987 European Pat. Off. ..... 355/210
55-142372 11/1980 Japan .
61-48152 10/1986 Japan .

*Primary Examiner*—Joan H. Pendegrass
*Attorney, Agent, or Firm*—Armstrong, Nikaido, Marmelstein, Kubovcik & Murray

[57] ABSTRACT

An image formation apparatus having at least one guide roller (23) for guiding a medium (100) on which an image is to be formed, and a detachable process cartridge (11) having a photoconductive drum (13) incorporated therein, and further comprising at least one pinch roller (21) provided in the process cartridge (11) to come into elastic contact with a corresponding guide roller (23).

10 Claims, 5 Drawing Sheets

IMAGE FORMATION APPARATUS HAVING A PROCESS CARTRIDGE ACTING AS GUIDANCE FOR A MEDIUM

BACKGROUND OF THE INVENTION

1. Field of the Invention

The present invention relates to an image formation apparatus provided with a process cartridge unit which comprises at least a photoconductive drum and a developer.

2. Description of the Related Art

In general, prior image formation apparatuses such as an electrostatic printer include a photoconductive drum around which a series of elements are arranged for forming a latent image on the surface of the drum, developing a toner image from the latent image, and transferring the toner image to a medium.

FIG. 7 shows a main structure of such a prior type printer. In the figure, 1 is a process cartridge, 2 is a transfer-charger, and 3 is a transfer path for a medium (sheet). The process cartridge 1 includes a photoconductive drum 4, a precharger 5, a developer 6, and a cleaner 7. The developer 6 contains toner 8 and is provided with a magnetic roller 9.

The formation of a toner image on the surface of the photoconductive drum 4, and the transfer of that image, are carried out in the following manner:

First, the photoconductive drum 4 is driven to be rotated clockwise and is uniformly charged by the precharger 5. Then, a static latent image corresponding to information is formed on the surface of the drum 4 by a latent image-forming means, such as an LED array, and is developed by the developer 6 from a toner supplied thereto by the magnetic roller 9. The latent image is transferred at point (A) by the transfer-charger 2 onto a sheet which is supplied, as indicated by an arrow, through the path 3 in synchronism with the rotation of the photoconductive drum 4. After the image-transference, the sheet is conveyed to the position (B) and the toner image is fixed thereon by a fuser 10, and finally, the sheet is discharged onto a stacker. The charge on the surface of the photoconductive drum 4 is removed by a discharger, and residual toner powder is withdrawn by the cleaner 7.

In the above-described printer, however, the design is limited in practice due to the existence of the path 3 in addition to the process cartridge 1, and thus, the printer is inevitably larger in size than is desirable, and the cost of manufacturing such a printer is high.

SUMMARY OF THE INVENTION

The primary object of the present invention is, therefore, to provide an image formation apparatus which is free from the aforementioned drawbacks and which ensures the realization of a simple and compact structure thereof.

To achieve the above object, according to the present invention, there is provided an image formation apparatus comprising at least one guide member for guiding a medium on which an image is to be formed, a detachable process cartridge having an image carrier incorporated therein, and at least one pinch roller provided in the process cartridge to come into elastic contact with the corresponding guide member.

With this arrangement, the medium to be recorded can be reliably and stably introduced into the apparatus by both the pinch roller and the corresponding guide member.

Preferably, the process cartridge includes a frame defining a toner vessel, an upper surface of which defines a guide path for the medium, whereby the size and manufacturing cost of the apparatus can be reduced because the upper surface of the cartridge is used as a guide passage for the medium but a specific transfer path forming member is not provided therein.

BRIEF DESCRIPTION OF THE DRAWINGS

These and other objects of the present invention will become apparent from the following detailed description of the preferred embodiment of the invention, taken in connection with the accompanying drawings.

In the drawings.

DESCRIPTION OF THE PREFERRED EMBODIMENT

Figure 1:
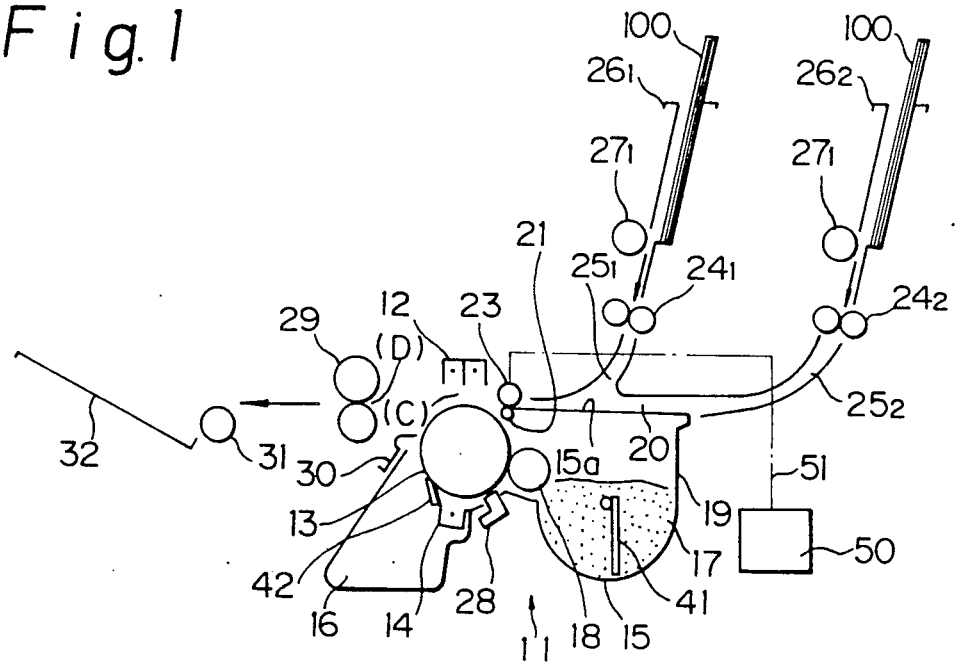
FIG. 1 is a schematic side view illustrating a main structure of a printer according to an embodiment of the invention.
Figure 2:
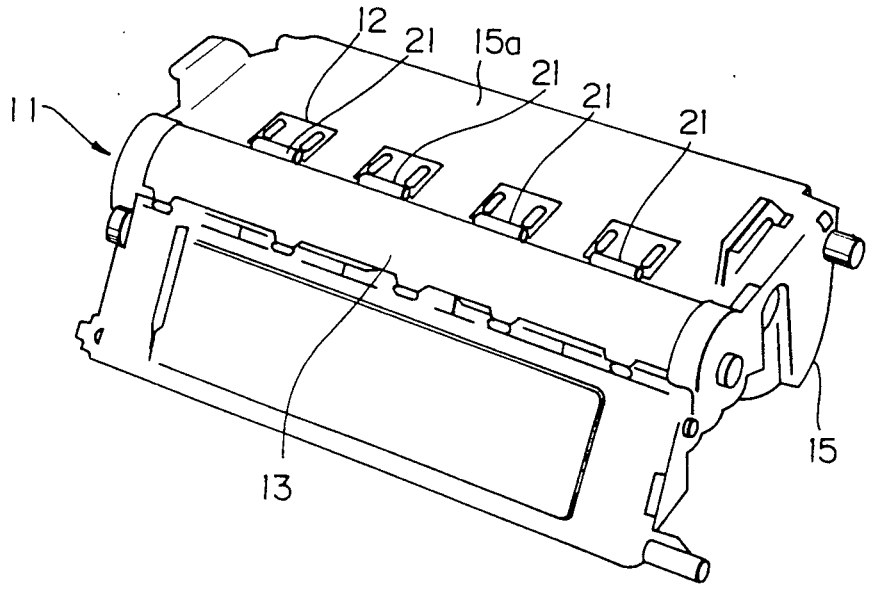
FIG. 2 is a perspective view of a process cartridge.

Referring now to the drawings, wherein like reference characters designate like or corresponding parts throughout the drawing, FIG. 1 shows a main structure of a printer according to an embodiment of the instant invention, which comprises a process cartridge, generally designated 11, shown in perspective in FIG. 2.

The process cartridge 11 is a composite body in which a photoconductive drum 13, a precharger 14, a developer 15, and a residual toner withdrawal vessel 16 are integrally and compactly combined. The cartridge 11 is easily attached to and detached from the body of the printer. The developer 15 comprises a toner vessel 19 holding a toner powder 17 and having an agitator 41 and a developing roller 18, which in turn consists of a magnetic roller and a sleeve covered thereon. The developing roller 18 conveys a toner powder stirred and uniformly fed thereto onto the surface of the photoconductive drum 13, and the toner powder forms a toner image on the drum 13 corresponding to a latent image. In the residual toner withdrawal vessel 16, a cleaning blade 42 is provided as a cleaner to clean residual toner powder from the surface of the drum 13 after the toner is transferred to a medium 100, i.e., a cut sheet.

Figure 3A:
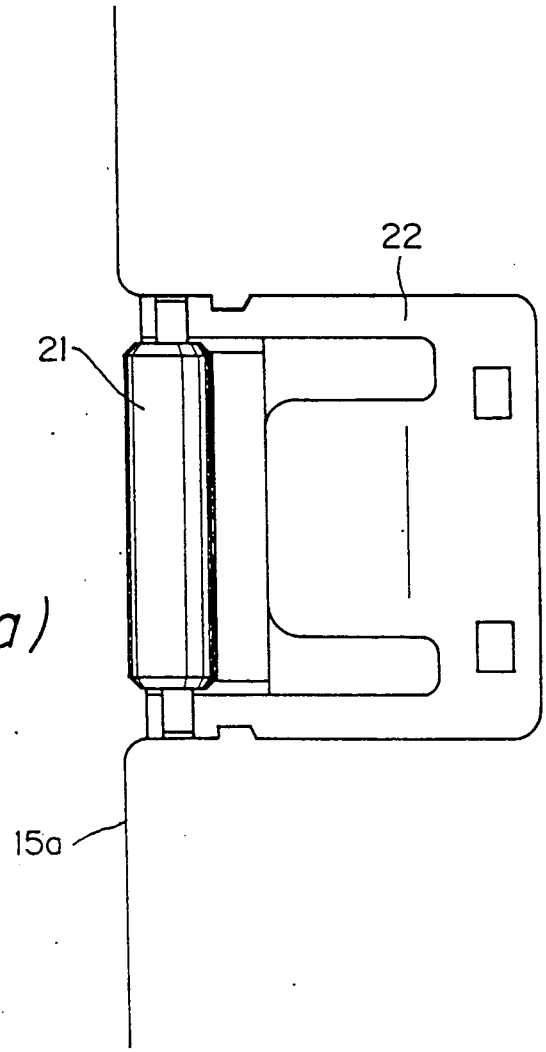
FIG. 3(*a*) and 3(*b*) are partial enlarged views of a blade spring and a pinch roller supported thereby, FIG. 3(*a*) being a plan view, and FIG. 3(*b*) being a side view.
Figure 3B:
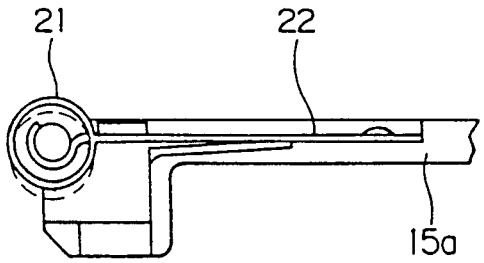

In this embodiment, an upper surface 15*a* of the process cartridge 11 constitutes a guide plate (path) for the cut sheets 100, and a plurality of pinch rollers 21 are provided at a front edge of the surface 15*a* and juxtaposed with each other in a direction of the width of the printer (or perpendicularly to a direction of conveying the sheets 100). As best illustrated in FIG. 3, these pinch rollers 21 are rotatably supported by resilient support members (a plurality of blade springs) 22 at the free ends thereof, and the base ends thereof are secured to the upper surface 15*a* of the cartridge 11 in the form of cantilever. The pinch rollers 21 are biased upward by the blade springs to be kept in resilient press contact with a corresponding guide member 23. The guide member 23 in the form of a guide roller in the illustrated embodiment is mounted on the upper frame unit of the printer and is rotated by a reversible motor 50. Accordingly, the cut sheet 100 can be easily introduced into an image transfer zone formed by the drum 13 and a transfer-charger 12, while nipped between the pinch rollers 21 and the guide roller 23.

In this embodiment of an image formation apparatus in accordance with the present invention, the formation and the transfer of a toner image are carried out as follows:

As shown in FIG. 1, two hoppers $26_1$ and $26_2$ are detachably secured to the upper frame unit of the printer, and accommodate different kinds of cut sheets 100. These hoppers $26_1$, $26_2$ are provided with pickup rollers $27_1$, $27_2$ corresponding, respectively, to regist rollers $24_1$, $24_2$. During the printing operation, either one of the hoppers $26_1$, $26_2$ is selected, the cut sheets 100 are removed from the hopper one by one, forwarded by the regist roller, delivered along the path 20 via the transfer path $25_1$ or $25_2$ in synchronism with the rotation of the photoconductive drum 13, and sequentially introduced into an image transfer zone (C), at which the toner image is transferred, formed by the drum and the transfer-charger 12, while being nipped by and guided between the pinch rollers 21 and the guide roller 23.

First, the photoconductive drum 13 is rotated counterclockwise in FIG. 1, and the surface thereof is uniformly charged by the precharger 1. Then, a static latent image corresponding to information is formed on the surface of the drum 13 by a latent image-forming means 28, such as an LED array, and is developed (with toner) by the developer 15 composed of the developing roller 18.

In the image transfer position (C), the latent image is transferred by the transfer-charger 12 onto the sheet 100 supplied as described above, and after the transfer formation, the sheets 100 are conveyed to a fixing position (D) at which the toner image is fixed thereon by a fuser 29. Finally, the printed sheets 100 are discharged onto a stacker 32 by an eject roller 31. Then, the charge on the surface of the photoconductive drum 13 is removed by a discharger 30, and the surface of the drum 13 is wiped by the cleaning blade 42 so that residual toner powder thereof is withdrawn to the vessel 16.

In the present embodiment, the upper surface 15*a* of the process cartridge 11, as stated above, is used as a guide plate or path for the sheets 100; i.e., it is not necessary to provide a specific transfer path forming member, as in conventional printers, and thus the size of the printer and the cost thereof can be reduced.

In addition, the medium 100 in the path 20 can be easily and reliably introduced into the image transfer zone by the pinch rollers 21 which are biased upward to be kept in resilient press contact with the guide roller 23.

The guide roller 23, similar to other rotating elements of the printer, is driven to rotate by the reversible motor 50 provided in the lower cover unit of the printer as a common drive source, and torque from the motor 50 is transmitted through a transmission mechanism 51 including a plurality of gears provided in the lower cover unit and the upper frame unit of the printer.

A detailed description and drawings of the above mentioned transmission mechanism 51 are omitted from this specification, since the mechanism 51 is already disclosed in detail in U.S. application Ser. No. 250,173 in the name of the applicant filed Sept. 8, 1988 (based on Japanese Unexamined Patent Publication (Kokai) No. 62-246716 filed Sept. 30, 987), and immediately related to the present invention.

Figure 5:
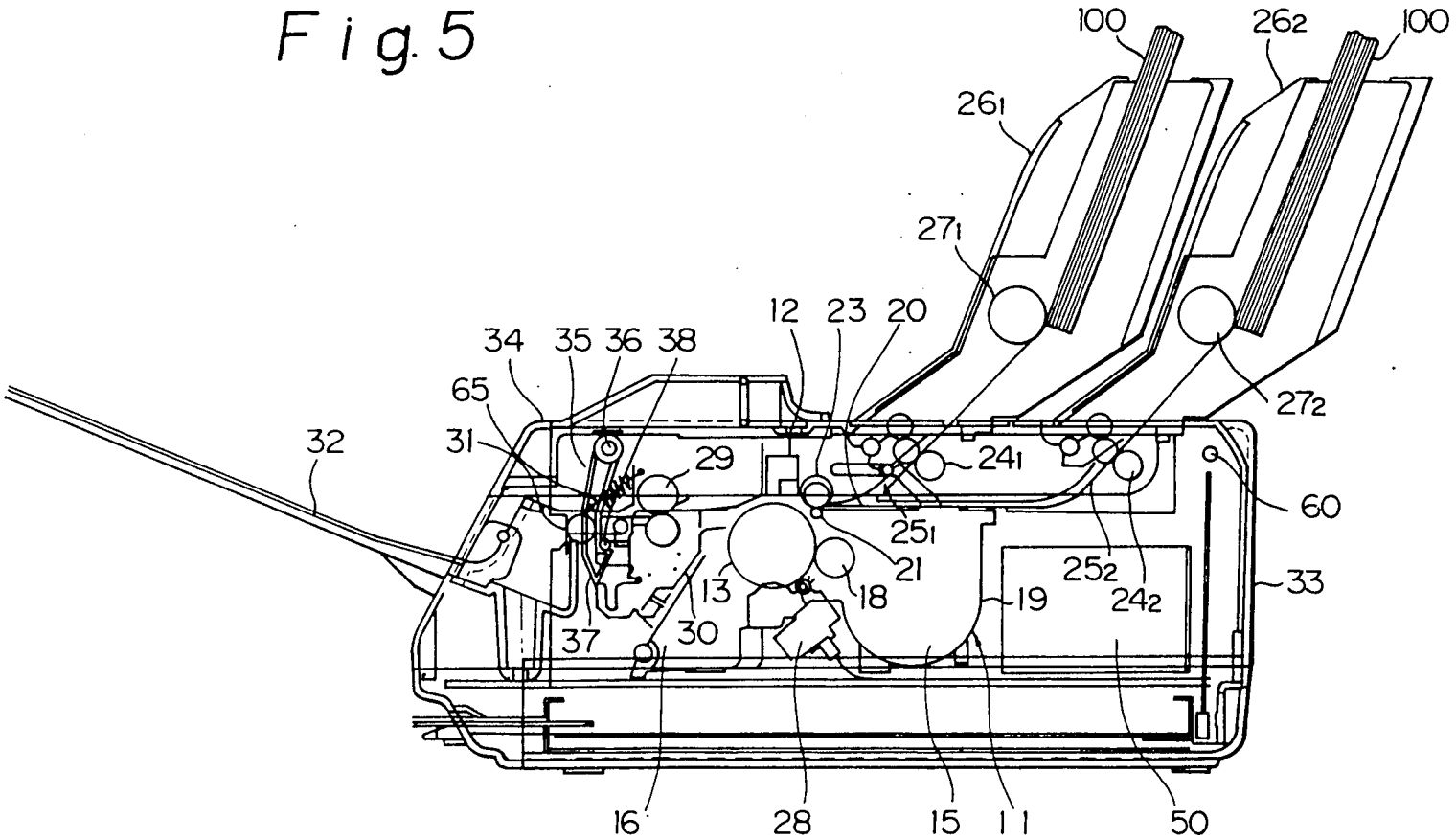
FIG. 5 is a schematic side elevational view of a printer including a main structure as illustrated in FIG. 1.
Figure 6:
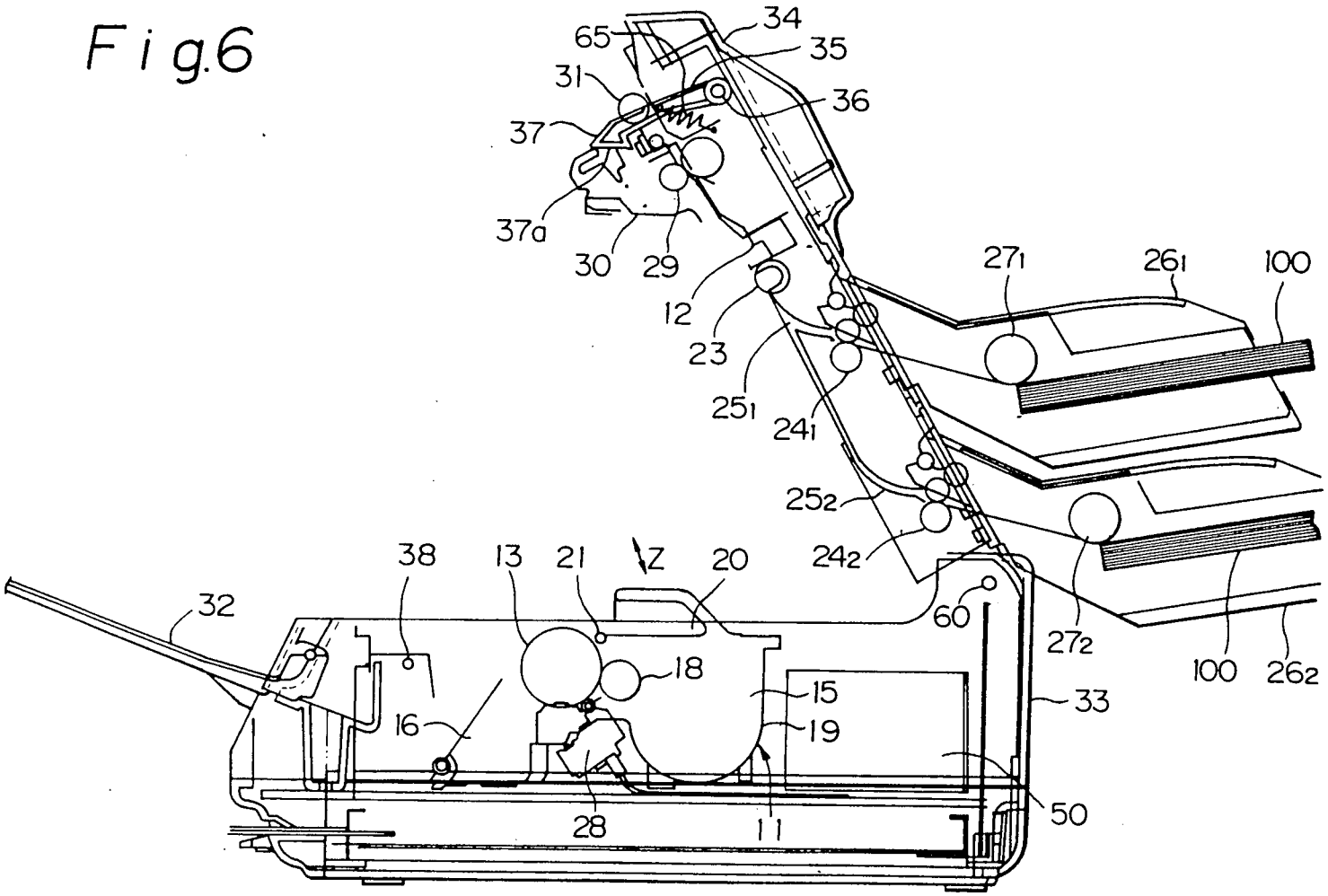
FIG. 6 is a view showing an opened state of the printer illustrated in FIG. 5.

FIGS. 5 and 6 show a schematic side elevational view of a printer providing the above described main structure for printing. The printer comprises a clam shell type housing having a lower cover unit 33 and an upper frame unit 34 detachably connected to each other by a hinge 60, so that the upper frame unit 34 rotates upward and downward around the hinge 60, as shown in FIG. 6, for easy maintenance.

The process cartridge 11 is installed in the lower cover unit 33 and is detachable therefrom in the direction of shown by an arrow Z. The LED array 28 and the motor 50 are also mounted therein.

The transfer-charger 12, the guide roller 23, the regist rollers $24_1$, $24_2$, the path $25_1$, $25_2$, the fuser 29, the discharger 30, and the eject rollers 31 are provided in the upper frame unit 34, and two hoppers 26, 26 are detachably secured to the unit 34.

When the process cartridge is to be replaced or maintenance and trouble-shooting, e.g., paper jam inside the printer, the upper frame unit 34 is opened as shown in FIG. 6.

Figure 4:
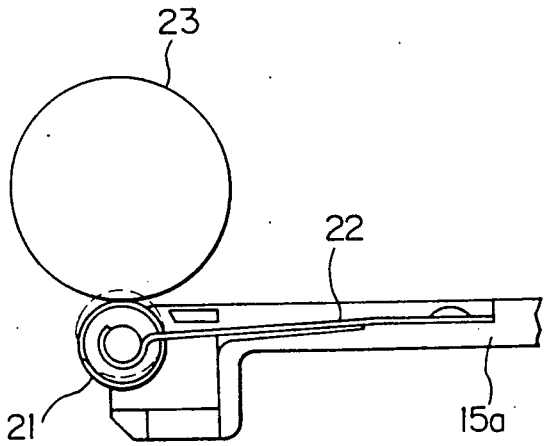
FIG. 4 is a partial enlarged side view of the pinch roller and the blade spring in a normal condition in which the printer is set to operate, wherein the spring is bent down by a guide roller which is in contact with the pinch roller and is driving it in a pushing direction.
Figure 7:
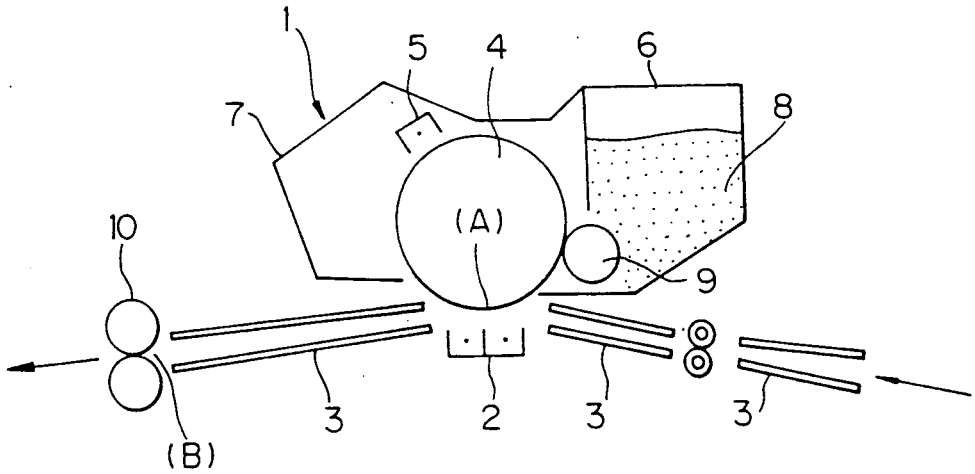
Fig. 7 PRIOR ART
FIG. 7 is a side view showing an outline of the conventional printer.

When the printer is used, the upper frame unit 34 is pushed down counterclockwise from the position shown in FIG. 6. At the final stage of closing the upper frame unit 34, a hooked member 35 provided on the unit 34 and having one end rotatably supported by a support shaft 36, and biased in the counterclockwise direction by a spring 65, is abutted against a catch pin 38 provided in the lower cover unit 33, having a tapered face 37*a* of a hooked portion 37 thereof hooked member 35 is rotated clockwise against pulling force of the spring 65 while the unit 34 is advanced to be rotated. Then, at the last stage in which the unit 34 is fully closed as shown in FIG. 5, the unit 34 is locked because the hooked portion 37 is caught by the catch pin 38. In this state, the pinch rollers 21 supported and biased by the blade springs are in contact with the guide roller 23 as shown in FIG. 4, and other member of the unit 34 are accurately positioned as shown in FIG. 5, such that the printer is ready for use.

Further, to detach and open the upper frame unit 34, the shaft 36 can be operated and rotated clockwise from the outside, so that the hooked portion 37 is disengaged from the catch pin 38.

In the embodiment, in addition to the photo-conductive drum 13, the process cartridge 11 has integrally incorporated therein the precharger 14, the developer 15, and the cleaner such as the cleaning blade 42, but the present invention is by no means limited to this arrangement. For example, the process cartridge 11 may additionally incorporate a latent image-forming means such as an LED array 28.

From the foregoing, it can be seen that the present invention provides a simple and compact printer which is economically and accurately constructed from a single process cartridge, the upper surface of which can be used as a guide plate or a guide path for a medium travelling from a hopper or hoppers to an image transfer zone, and thus it is not necessary to provide specific transfer path members in the printer. The medium on the upper surface of the cartridge is nipped and guided between pinch rollers and guide roller to be reliably conveyed to the zone, and thus jamming is minimized. Further, even if a jam occurs during the printing operation, it is easily cleared since the pinch rollers and the guide roller can be conveniently detached and separated from each other.

While the invention has been particularly shown and described in reference to preferred embodiments thereof, it will be understood by those skilled in the art that changes in form and details may be made therein without departing from the spirit and scope of the invention.

We claim:

1. An image formation apparatus comprising:

at least one guide member means for guiding a medium on which an image is to be formed; and a detachable process cartridge means mounted within said image formation apparatus for guiding said medium, said process cartridge means having an image carrier and at least one pinch roller incorporated therein, wherein said pinch roller is provided in the process cartridge means to come into elastic contact with a corresponding guide member means, and wherein said pinch roller and a surface of said detachable process cartridge means guide said medium.

2. An image formation apparatus according to claim 1, wherein said image carrier is a photoconductive drum.

3. An image formation apparatus according to claim 1, wherein said guide member means is a guide roller.

4. An image formation apparatus according to claim 2, wherein said process cartridge includes a frame which defines a vessel containing a toner.

5. An image formation apparatus according to claim 4, wherein said frame of the process cartridge has an upper surface which defines said guiding surface for the medium.

6. An image formation apparatus according to claim 1, further comprising a supporting means for elastically and deformably supporting said at least one pinch roller bringing the pinch rollers into press contact with the guide member.

7. An image formation apparatus according to claim 6, wherein said supporting means comprises a cantilever type supporting arm which supports the pinch roller at a free end thereof.

8. An image formation apparatus according to claim 7, wherein said supporting arm is in the form of a plate blade spring.

9. An image formation apparatus according to claim 6, wherein said supporting means has an elasticity and is continuously biased toward the guide member.

10. An image formation apparatus according to claim 6, wherein said pinch roller is located in a vicinity of the image carrier in the extension of the guide path.

* * * * *